US007901610B2

(12) United States Patent
Joo et al.

(10) Patent No.: US 7,901,610 B2
(45) Date of Patent: Mar. 8, 2011

(54) METHOD FOR ELEVATED TEMPERATURE ELECTROSPINNING

(75) Inventors: Yong Lak Joo, Ithaca, NY (US); Huajun Zhou, Ithaca, NY (US)

(73) Assignee: Cornell Research Foundation, Inc., Ithaca, NY (US)

( * ) Notice: Subject to any disclaimer, the term of this patent is extended or adjusted under 35 U.S.C. 154(b) by 499 days.

(21) Appl. No.: 12/007,409

(22) Filed: Jan. 10, 2008

(65) Prior Publication Data

US 2008/0122131 A1 May 29, 2008

Related U.S. Application Data

(62) Division of application No. 10/965,813, filed on Oct. 18, 2004, now Pat. No. 7,326,043.

(60) Provisional application No. 60/583,358, filed on Jun. 29, 2004.

(51) Int. Cl.

| | |
|---|---|
| ***D02J 13/00*** | (2006.01) |
| ***D04H 3/02*** | (2006.01) |
| ***D06M 10/00*** | (2006.01) |
| ***H05B 7/00*** | (2006.01) |

(52) U.S. Cl. ..... 264/465; 264/103; 264/235

(58) Field of Classification Search ..... 264/103, 264/235, 465

See application file for complete search history.

(56) References Cited

U.S. PATENT DOCUMENTS

| | | | | |
|---|---|---|---|---|
| 3,860,369 | A | 1/1975 | Brethauer et al. | |
| 6,382,526 | B1 | 5/2002 | Reneker et al. | |
| 6,616,435 | B2 | 9/2003 | Lee et al. | |
| 6,656,394 | B2 | 12/2003 | Kelly | |
| 6,679,441 | B1 | 1/2004 | Borra et al. | |
| 6,685,956 | B2 | 2/2004 | Chu et al. | |
| 6,713,011 | B2 | 3/2004 | Chu et al. | |
| 6,753,454 | B1 | 6/2004 | Smith et al. | |
| 7,326,043 | B2 | 2/2008 | Joo et al. | |
| 2001/0046599 | A1 | 11/2001 | Kelly | |
| 2002/0089094 | A1 | 7/2002 | Kleinmeyer et al. | |
| 2002/0100725 | A1 * | 8/2002 | Lee et al. | 210/503 |
| 2003/0054035 | A1 * | 3/2003 | Chu et al. | 424/486 |
| 2003/0065355 | A1 * | 4/2003 | Weber | 606/200 |
| 2003/0195611 | A1 | 10/2003 | Greenhalgh et al. | |
| 2007/0018361 | A1 * | 1/2007 | Xu | 264/465 |
| 2007/0035055 | A1 * | 2/2007 | Gee et al. | 264/465 X |

* cited by examiner

*Primary Examiner* — Leo B Tentoni
(74) *Attorney, Agent, or Firm* — Hodgson Russ LLP

(57) ABSTRACT

Elevated temperature electrospinning apparatus comprises a pump upstream of or containing a resistance heater, means to shield applied electrostatic field from the resistance heater, and a temperature modulator for modulating temperature in the spinning region.

10 Claims, 1 Drawing Sheet

44
48
46
32
34
R
28
40
26
25
30
42
20
41
14
16
11
10
13
23
15
18
22
12

60
66
64
68
65
58
63
56
62
54
52
50

METHOD FOR ELEVATED TEMPERATURE ELECTROSPINNING

CROSS-REFERENCE TO RELATED APPLICATIONS

This application is a division of U.S. application Ser. No. 10/965,813, filed Oct. 18, 2004 now U.S. Pat. No. 7,326,043 which claims the benefit of U.S. Provisional Patent Application No. 60/583,358, filed Jun. 29, 2004, the whole of which is incorporated in Ser. No. 10/965,813 by reference.

TECHNICAL FIELD

This invention is directed to relationship of elevated temperature electrospinning apparatus components, including isolation of the chamber supplying heat for melting and temperature control in the spinning region.

BACKGROUND OF THE INVENTION

Fibers with diameters less than a micron can be formed using electrospinning processes where a droplet of polymer solution or melt is elongated by a strong electrical field. The resulting fibers are collected as non-woven mats with extremely large surface to volume ratio; which are useful for various applications including filtration. Most previous studies on electrospinning have focused on fibers from polymer solutions, i.e., are directed to solution electrospinning. Current solution electrospinning apparatus and processes have the disadvantages of requiring a dissolving step, of requiring solvent recovery and disposal or complete recycling if the process is to be environmentally friendly, of having low production rates because of the dissolving and solvent recovery/recycling steps detracting from obtaining high throughput, of not being adaptable to polymers such as polyethylene, polypropylene, polyethylene terephthalate and polybutylene terephthalate, which are not dissolvable in acceptable solvents at room temperature, of requiring regulation of a plurality of parameters to adjust molecular properties and solidification and of requiring apparatus not readily provided by adaptation of conventional existing facilities for fiber/non-woven production for most polymers since these are based on melt treatment. Melt electrospinning apparatus and process which would avoid these disadvantages and provide useful production of fibers/non-wovens have not heretofore been developed. Moreover, no attempts have been made to provide solution electrospinning apparatus and processes which are suitable for operation on polymers which are not dissolvable in acceptable solvents at room temperature.

SUMMARY OF THE INVENTION

It has been discovered herein that apparatus and process avoiding the disadvantages of conventional solution electrospinning apparatus and process and providing useful melt electrospinning production of polymer and nanocomposite fibers/non-wovens and useful solution electrospinning apparatus and processes for operation on polymers which are not dissolvable in acceptable solvents at room temperature, can be provided by relying on unique heating apparatus/process.

In one embodiment herein, the invention is directed to apparatus for elevated temperature production of non-woven fabric from thermoplastic polymer or thermoplastic polymer nanoclay nanocomposite, neat or in solution and requiring elevated temperature for dissolving in an acceptable solvent, said apparatus comprising a resistance heater for melting the polymer or nanocomposite or maintaining the polymer or nanocomposite in solution in acceptable solvent; a pump upstream of or containing the resistance heater for dispensing said melted polymer or nanocomposite or solution; a droplet forming passageway for receiving said polymer or nanocomposite melt or solution and having one or more outlet orifices for providing one or more droplets of melted polymer or nanocomposite or solution at the one or more outlet orifices; a guiding chamber having an inlet side in fluid communication with the outlet orifice(s); a collection surface at the rear side of the guiding chamber for receiving elongated fibers of polymer or nanocomposite and collecting them as a non-woven fabric; and a high voltage source in electrical communication with the droplet forming passageway to provide an electric charge in the droplet(s) emitting therefrom to overcome the surface tension of a droplet to produce a jet of melted polymer or nanocomposite or solution in the guiding chamber giving rise to unstable flow through the guiding chamber to the collection surface manifested by a series of electrically induced bending instabilities and flashing off of any solvent during passage of polymer or nanocomposite to the collection surface and production of elongated fibers of polymer or nanocomposite and deposit of these on the collection surface so as to form the non-woven fabric. In the apparatus preferably, the electrical communication of the high voltage source is shielded from the resistance heater to prevent induced voltage in the resistance heater and a temperature modulator is provided for the guiding chamber to adjust cooling of the fiber being formed to provide against premature solidification and to provide against induction of relaxation of molecular orientation, and to potentiate flashing off of any solvent, without affecting the bending instabilities causing fiber elongation.

The term "elevated temperature" as used herein, refers to melt electrospinning production, or solution electrospinning production in an acceptable solvent at a temperature ranging from 50° C. to 250° C.; for solution electrospinning of polyolefins a temperature ranging from 120° C. to 180° C. is preferred.

The term "acceptable solvent" as used herein, means a solvent satisfying the following requirements: (i) the solubility is higher at elevated temperature than at room temperature; (ii) the flashpoint is below the spinning temperature; (iii) the solvent is sufficiently volatile so as to evaporate during the spinning process; and (iv) the solvent's odor threshold level is higher than 0.1 ppm.

Said apparatus which is for batch operation can comprise the following elements:

(a) a syringe having an inlet for introduction into the syringe of solid meltable thermoplastic polymer or solid meltable thermoplastic polymer nanoclay nanocomposite or solution of thermoplastic polymer or thermoplastic polymer nanoclay nanocomposite requiring elevated temperature for dissolving in an acceptable solvent, and an outlet for dispensing of melted thermoplastic polymer or nanocomposite or elevated temperature solution, (b) a heating chamber in heat exchange communication with the syringe to supply heat to the syringe to melt polymer or nanocomposite or maintain polymer or nanocomposite in solution within the syringe, (c) droplet forming passageway having an inlet in fluid communication with the outlet of the syringe and one or more outlet orifices for providing one or more droplets of polymer or nanocomposite melt or elevated temperature solution at the one or more outlet orifices;

(d) a pump upstream of the inlet of the syringe for causing the syringe to dispense melted polymer or nanocomposite or elevated temperature solution to be electrically charged, (e) a guiding chamber having inlet side in fluid communication with the orifice outlet(s);

(f) a collection surface at a rear end of the guiding chamber; and (g) a high voltage source in electrical communication with the droplet forming passageway to provide an electric charge in the formed droplet(s) emitting therefrom to overcome the surface tension of a droplet to produce a jet of melted polymer or nanocomposite or elevated temperature solution in the guiding chamber giving rise to unstable flow through the guiding chamber to the collection surface manifested by a series of electrically induced bending instabilities. i.e., whipping motions, and flashing off of any solvent, during passage to the collection surface, and production of elongated fibers of the polymer or nanocomposite which are deposited on the collection surface where they are collected as a non-woven fabric.

In a preferred case, said apparatus for batch operation also comprises at least one of the following elements of (h), (i) and (j) or any two of the elements, and preferably all of the following elements (h), (i) and (j):

(h) a temperature modulator for the guiding chamber to adjust cooling of the fiber being formed to provide against premature solidification and to provide against relaxation of induction of molecular orientation and to potentiate flashing off of any solvent, without affecting the bending instabilities causing fiber elongation, (i) a controller for controlling temperature in the heating chamber, a heating coil in the heating chamber, and shielding for the heating coil inside the heating chamber to prevent induced voltage in the heating coil from the electric charge supplied by the high voltage source so that induced voltage will not affect or damage the controller, and (j) the heating chamber being constructed of material comprising a substance that provides both thermal and electrical insulation.

Very preferably, the apparatus for batch operation also comprises a modulator for the temperature of the collection surface to provide annealing of fibers deposited and collected on the collection surface to provide fibers on the collection surface with properties that do not change with time and increased molecular orientation such as increased crystallinity.

Said apparatus which is for continuous melt electrospinning operation and for production of non-woven fabric from thermoplastic polymer or thermoplastic polymer nanoclay nanocomposite, can comprise a hopper for containing and feeding chunks of thermoplastic polymer or thermoplastic polymer nanoclay nanocomposite; an extruder for receiving the chunks of polymer or nanocomposite and conveying, melting and pumping the polymer or nanocomposite to produce a flow of polymer or nanocomposite melt therefrom; a melt pump for receiving polymer or nanocomposite melt from the extruder and for maintaining the melted condition of the polymer or nanocomposite melt by means of electric resistance heating and providing a melt output; a header (manifold) for receiving the melt output and distributing it to multiple nozzles for forming droplets of polymer or nanocomposite melt; a guiding chamber for receiving the output of the nozzles; a collection surface at the rear of the guiding chamber; a high voltage source in electrical communication with the nozzles to provide an electric charge in the droplets emitting therefrom to overcome the surface tension of a droplet to produce a jet of polymer or nanocomposite melt giving rise to unstable flow through the guiding chamber to the collection surface manifested by a series of electrically induced bending instabilities during passage to the collection surface and production of elongated fibers of the polymer or nanocomposite which are deposited on the collection surface where they are collected as a non-woven fabric; a shield for the header and nozzles to prevent induced voltage in the melt pump from the electric charge supplied by the high voltage source; and an infrared heater for the guiding chamber to adjust cooling of the fiber formed therein to provide against premature solidification and to provide against induction of relaxation of molecular orientation, without affecting the bending instabilities causing fiber elongation.

In a second embodiment herein, the invention is directed at a method for melt electrospinning production of nonwoven fiber from meltable thermoplastic polymer or meltable thermoplastic polymer nanoclay nanocomposite, said method comprising the steps of:

(a) melting thermoplastic polymer or nanocomposite in a melting zone, (b) moving the thermoplastic polymer or nanocomposite through the melting zone by force supplier upstream of or in the melting zone, (c) forming droplets of the melted polymer or nanocomposite, (d) providing an electric charge on the droplets to overcome the surface tension of a droplet to produce a jet of melted polymer or nanocomposite and provide unstable flow involving a plurality of electrically induced bending instabilities/whipping motions and elongation of and production of polymer or nanocomposite fibers, (e) collecting of elongated fibers to form a non-woven fiber.

A preferred method of said second embodiment also comprises at least one of the following elements (f) and (g) and very preferably both of the following elements (f), and (g):

(f) providing a temperature for the polymer or nanocomposite being subjected to electrically induced bending instabilities/whipping motions and elongation to provide against premature solidification and to provide against induction of relaxation of molecular orientation without affecting the electrically induced bending instabilities, (g) shielding to prevent induction voltage of in the melting zone.

Very preferably the method of said second embodiment also comprises the additional step of annealing the collected fibers to impart stability and molecular orientation thereto.

In a third embodiment herein, the invention is directed at a method for high temperature solution electrospinning of nonwoven fabric from thermoplastic polymer or thermoplastic polymer nanoclay nanocomposite that is not dissolvable at room temperature in an acceptable solvent, said method comprising the steps of:

(a) homogenizing the polymer or nanocomposite in solvent in an elevated temperature zone to form a solution of the polymer or nanocomposite in the solvent;

(b) maintaining the solution at a temperature sufficient for maintaining dissolution in a second elevated temperature zone;

(c) moving the solution through the second elevated temperature zone by a force supplier upstream of or at the second elevated temperature zone;

(d) forming droplets of the solution moved through the second elevated temperature zone;

(e) providing an electric charge on the droplets to overcome the surface tension of a droplet to produce a jet of polymer or nanocomposite solution and provide unstable flow involving a plurality of electrically induced bending instabilities/whipping motions and flashing off of solvent and elongation of and production of polymer or nanocomposite fibers;

(f) collecting the fibers to form a non-woven fabric.

Preferably, the method of the third embodiment comprises at least one of the following steps (g) and (h) and ver preferably both of the following steps (g) and (h):

(g) providing a temperature for the polymer or nanocomposite and solution thereof being subjected to electrically induced bending instabilities/whipping motions and fiber elongation to provide against premature solidification and to provide against induction of relaxation of molecular orientation and potentiate flashing off of solvent, without affecting the electrically induced bending instabilities, (h) shielding to prevent induction of voltage in the second elevated temperature zone.

Very preferably, the method of the third embodiment comprises the additional step of annealing the collected fibers to impart stability and molecular orientation.

DETAILED DESCRIPTION

Figure 1:
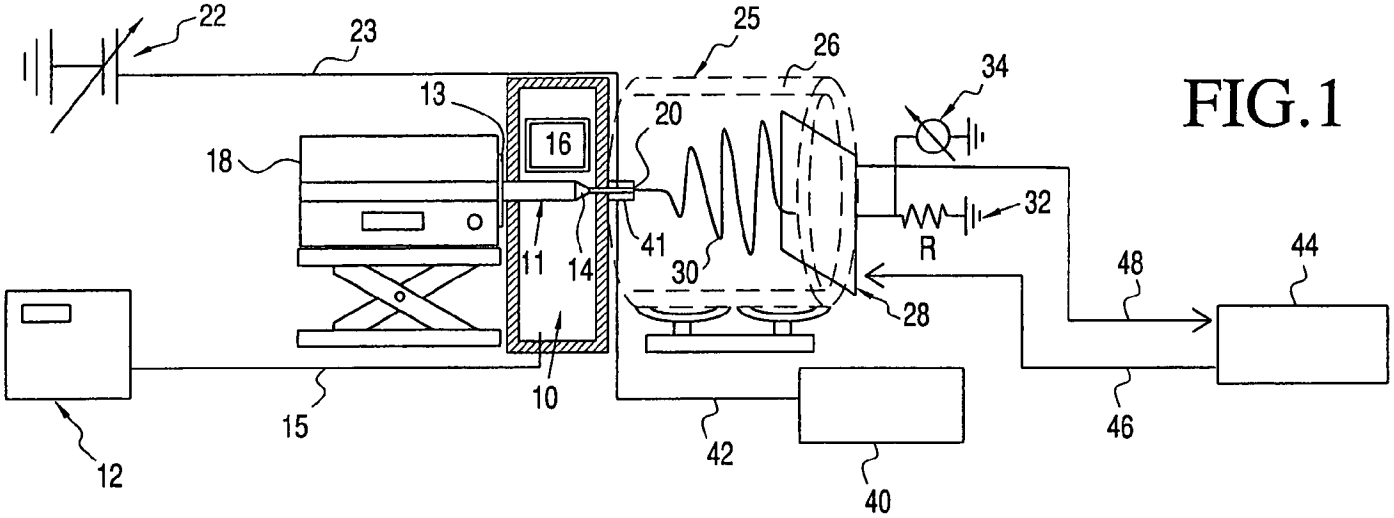
FIG. 1 is a schematic description of elevated temperature electrospinning apparatus of the invention herein for batch operation.

To aid in the understanding of melt electrospinning, the following discussion is provided.

An electric charge is generated on a formed suspended drop of melted polymer or nanocomposite. This charge overcomes the surface tension of the suspended drop to produce an electrically charged jet of melted polymer or nanocomposite which undergoes a series of electrically induced bending instabilities whereby repulsion of adjacent charged segments generates vigorous whipping motion during passage to a collection surface resulting in significant elongation and stretching of the produced fiber. The stretched fibers are accumulated on the surface of a collection plate resulting in nonwoven fabric including mesh of nanometer to micron diameter fibers. Varying of the electric field strength/electric charge, drop forming nozzle orifice temperature, nozzle diameter, flow rate, distance from nozzle to collection plate and temperature during elongation, controls the fiber diameter.

In the elevated temperature solution electrospinning herein the difference from the above paragraph is that the suspended drop is of elevated temperature polymer or nanocomposite solution. The whipping action described above occurs in electrically charged jet of solution just as in electrically charged jet of melt because of variation of surface charges and electric field which occur in a solution as well as in a melt. A difference from melt electrospinning is that solvent flashes off during fiber formation and elongation and is removed from the system. Variation of electric field strength/electric charge, nozzle orifice temperature, nozzle diameter, flow rate, distance from nozzle to collecting plate and temperature during elongation, controls the fiber diameter.

We turn now to the polymer and nanocomposite which can be processed in apparatus of the invention by means of melt electrospinning operation. The polymer can be any meltable thermoplastic polymer including amorphous and crystallizing polymers, e.g., amorphous polymers such as rubber, polycarbonate, polystyrene and poly(methyl methacrylate); slow crystallizing polymers such as poly(lactic acid) denoted PLA; medium crystallizing polymers such as polyethylene terephthalate; fast crystallizing polymers such as polybutylene terephthalate, nylon 6, polypropylene and polyethylene; and very fast crystallizing polymers such as nylon 6,6.

As used herein, the term "nanocomposite" means composition of nanoclay in a polymer matrix containing by weight, for example, up to 20%, e.g., 1 to 10%, nanoclay.

The term "nanoclay" means clay having nanometer thickness silicate platelets that can be modified to make clay compatible with organic monomers and polymers, i.e., by cation exchanging nanoclay, e.g., as obtained in the sodium form, with organic cation. The nanoclay can be, for example, montmorillonite (a natural clay) or fluorohectorate or laponite synthetic clays. Other useful nanoclays include, for example, bentonites, beidellites, hectorites, saponites, nontronites, sauconites, vermiculites, ledikites, magadiites, kenyaites and stevensites. Processes for making polymer/clay nanocomposites are known and have been patented and are under commercial development.

We turn now to polymer solutions which can be processed in apparatus of the invention by means of solution electrospinning operation. The polymers for the solutions as indicated above, are polymers which are not dissolvable in acceptable solvents at room temperature. These included polyolefins, e.g., polyethylene, polypropylene and polysobutylene, which are not dissolvable in any solvents at room temperature, but are dissolvable at elevated temperatures as described above. Suitable solvents for use in providing solutions of polyolefins at 100 to 180° C. for solution electrospinning herein include, for example, decalin, paraffin oil, ortho dichlorobenzene and xylene. Polymers which are dissolvable at room temperature, but for which no acceptable solvents are available for dissolving at room temperature, are some polyesters, e.g., polyethylene terephathalate (PET). While PET is readily dissolved at room temperature in phenol, residual phenol is present and is a problem even at a few parts per million, as it is poisonous and caustic and is readily absorbed through skin, and from the stomach and lungs. Acceptable solvents for PET at elevated temperatures of 50 to 200° C., include for example, toluene, benzene, chlorobenzene and xylene/chlorohexanone.

As it is clear from the above, polyolefins and polyethylene terephthalate can be used as polymer for either melt electrospinning operation or for elevated temperature solution electrospinning operation. In these cases, elevated temperature solution electrospinning may be preferred, because nanoscale diameter fibers can more easily be obtained with high temperature solution electrospinning that with melt electrospinning.

We turn now to apparatus of the invention herein involving batch operation.

With continuing reference to FIG. 1 of the drawings, there is depicted a heating chamber 10 containing an electrical resistance heating element (not shown), e.g., a heating coil. The heating chamber 10 is in heat exchange contact with a syringe 11, e.g., of circular cross-section of one-half to one inch diameter, which extends through chamber 10 with its longitudinal axis oriented horizontally. The syringe 11 is to house polymer or nanocomposite to be melted or elevated temperature solution of polymer or nanocomposite to be maintained at elevated temperature, and melted polymer or nanocomposite or elevated temperature solution of polymer or nanocomposite to be dispensed. The syringe 11 contains a plunger 13 at its inlet end for removal for introduction of solid polymer or nanocomposite or elevated temperature solution of polymer or nanocomposite and followed by reinsertion and movement forward to move polymer or nanocomposite or said elevated temperature solution first into heat exchange contact for melting of said polymer nanocomposite or maintaining the elevated temperature of polymer or nanocomposite solution and thereafter further forward for dispensing of melt or elevated temperature solution through a dispensing end 14. The temperature in the syringe, denoted $T_1$, is controlled by a temperature controller 12 to provide temperature in the heating element to control the viscosity of molten polymer or nanocomposite or elevated temperature solution being dispensed to one that will provide droplets of polymer or nanocomposite or polymer or nanocomposite as described later (e.g., a temperature of 200° C. for PLA). As indicated at 15 a thermocouple in communication with controller 12 is placed in chamber 10 to provide a feedback mechanism. The heating chamber is shown to contain a window 16 to allow visual access to the inside of the chamber 10 and of the syringe 11 to determine the presence of sparks and leakage and the extent of melting of polymer or nanocomposite in syringe 11. The walls of heating chamber 10 are preferably constructed of a material that provides both thermal insolation (to provide heating efficiency) and electrical insulation (to prevent leakage currents from applied high voltage, as described later, from entering the heating chamber, e.g., a material based on $CaSiO_3$, or a ceramic composite; glass also works. Movement of the syringe plunger 13 forward, e.g., by a mini-pump, connected to plunger 13, provides horizontal displacement of plunger 13 to continuously dispense droplets of polymer or nanocomposite or elevated temperature solution of polymer or nanocomposite as described later. A droplet forming passageway 20 having an inlet in fluid communication with the dispensing end 14 of syringe 11 and one or more outlets orifices (capillary tips) for providing one or more droplets of liquid polymer or nanocomposite at the one or more outlet orifices, is provided by a needle (e.g., a 24 gauge needle) or spinneret. A high voltage supplier 22 is present to supply high voltage (a typical voltage is 10 kV to 30 kV where the distance between the syringe tip/orifice outlet(s) and collector as described later is 2 to 10 inches) via a conductive element 23 to the syringe tip/orifice outlets to provide an electrostatic field strength, e.g., of 1 to 10 kV/cm, where cm refers to the distance between the droplet forming orifice of passageway 20 and the collector 28, to drive the flow of polymer or nanocomposite or elevated temperature solution and whipping action as described later. The resistance heating coil in heating chamber 10 is preferably protected from induction of voltage therein from said electrostatic field since induced voltage can affect the accuracy of or damage the controller 12. In addition to the electrically insulating material of construction of heating chamber 10, this is preferably provided by surrounding any heating coil in chamber 10 with an electrostatic shielding element (not shown), very preferably, a Faraday cage, also called a Faraday screen or Faraday shield, which is an enclosure surrounding the heating coil and made of screening, e.g., metal mesh of mesh size #5, which wraps around the heating coil without touching it, electrically attached to earth ground with a conductive wire. The Faraday cage eliminates any induced electrostatic voltage on the coil inside the cage. In the unit where runs were carried out herein, the coil and cage are positioned in parallel with the vertical walls of heating chamber 10. The temperature in the orifice forming passageway, denoted $T_2$, is preferably regulated and fine tuned, by use of a cylindrical heater as indicated at 41 electrically shielded in a ceramic cylinder, or by use of circulating hot air (elements(s) for providing this are not shown) to control the viscosity of the fluid exiting the passageway 20. The temperature $T_2$ is controlled by a controller 40 with feedback via 42 in response to results at the needle/spinneret 20. With increasing $T_2$, the viscosity decreases. Too high a viscosity can build up too much pressure, and too low viscosity can lead to break up of melt jet (described later) and no continuous fiber.

We turn now to the apparatus downstream of the syringe in addition to droplet forming passageway 20. A guiding chamber 25, e.g., of 5 to 12 inches in diameter, is in fluid communication with the orifice outlet(s) of passageway 20. Polymer or nanocomposite fiber is formed and significantly elongated in chamber 25. Surrounding the guiding chamber 25 is a glass heating duct 26 which is heated by hot air passing therethrough which supplies heat to air in the interior of the chamber, also known as the whipping region, by conduction. Alternatively, the chamber 25 may be subjected to infrared heating. The temperature in the guiding chamber 25 is denoted $T_3$. A reason for heating in the guiding chamber 25 is to control the solidification of fiber being formed and to potentate flashing of any solvent. Too rapid cooling gives rise to premature solidification, whereas to slow cooling induces relaxation of molecular orientation; both lead to poor fiber properties. More particularly, too rapid decrease in temperature $T_3$ leads to quenching crystallinity of crystallizing polymer and molecular orientation of amorphous polymer of the fiber whereas too high a temperature breaks up the fluid jet and/or induces relaxation which leads to poor fiber properties. Conventional fiber melt spinning processes utilize convection by air blowing to control temperature in their spinning regions; in the instant case, air blowing that destroys the whipping motion as described later, would antagonize proper fiber formation. At the rear end of chamber 25 is a collector 28 for collecting elongated fiber which is formed. The fiber undergoing whipping motion is denoted 30. The collector 28 is grounded as depicted at 32, so the voltage of the collector drops from tens of kV at the tip of the needle/spinneret 20 to a few volts at the collector. A resistor R is included downstream of the collector to enable measurement of the voltage of the collector via a meter 34. The temperature of collector 28 denoted $T_4$ provides annealing for the fiber on collection to provide more stable (no changes in properties with time) fiber with higher crystallinity for crystallizing polymers and better molecular orientation for amorphous polymers (and thus better properties). Too high a temperature $T_4$ will induce relaxation. The temperature $T_4$ is provided by circulating water through the interior of the collector from a temperature-controlled bath 44 via feed and return lines 46 and 48. Ideally a controller is present to control the temperature $T_3$ in response to results in the guiding chamber. The apparatus can be adapted from conventional melt fiber preparation apparatus.

We turn now to operation of the apparatus of FIG. 1 for melt electrospinning. Pellets of polymer or nanocomposite are introduced into syringe 11 whereupon plunger 13 is inserted and micro-pump 18 is positioned. The heating chamber 10 is heated. PLA of number average molecular weight of 186,000 and polydispersity 1.76 (determined by gel permeation chromatography using polystyrene standards) obtained from Cargill-Dow was used in experiments herein. When the polymer is PLA, a useful temperature obtained in chamber 10/syringe 11 is 200° C. The polymer/nanocomposite is maintained in the syringe at preselected melting temperature for a period sufficient to obtain melting of all the polymer/nanocomposite in the syringe, e.g., 30 minutes. Thereupon micropump 18 is used to push polymer through syringe 11 to continuously implement formation of a droplet(s) of polymer or nanocomposite, and high voltage source 22 effects a voltage, e.g., of 10 to 20 kV, at the tip(s) or orifices of 20 positioned 2 to 12 inches, e.g., 6 inches, from the collector 28 to effect an electrostatic field strength of 1 to 10 kV/cm distance between tip and collector in the droplet to drive fiber forming. The field strength applied is sufficient to supply a charge to formed droplets which overcomes surface tension of the droplet(s), to produce an electrified jet of molten polymer or nanocomposite to provide unstable flow, starting with axisymmetric modulation and progressing to a plurality of electrically induced bending instabilities/whipping motions (repulsion of adjacent segments generates a vigorous whipping motion) and stretching of the fibers which are being formed and production of solidified elongated fibers. For non-polar melts, e.g., melts of polymers of polyolefins such as polyethylene (LDPE, LLDPE and HDPE), the end of the aforestated electrostatic field strength range for electrospinning (5 to 10 kV/cm out of 1 to 10 kV/cm) is required. The temperature $T_2$ is provided by shielded electric resistance heater 41, to effect low enough viscosity so there is not inappropriate pressure buildup but not so low as to cause break-up of the melt jet (e.g., 200-230° C. for PLA). A temperature $T_3$ is provided which does not quench the fiber and does not break up the fluid jet or induce relaxation (e.g., 40 to 120° C. for PLA). The elongated solidified fiber is deposited and collected on collector 28 which is maintained at a temperature $T_4$ by circulating temperature controlled water as indicated at 44, 46 and 48 for annealing the fibers to provide more stable (no change in properties with time) fibers with higher crystallinity for crystallizing fibers and better molecular orientation for amorphous fibers ($T_4$ between room temperature and 80° C. was used for PLA). Typical annealing temperatures range from 60 to 120° C. and typical annealing times range from 60 to 300 minutes. A volumetric flow rate of 0.005 to 0.025 ml/min, typically 0.005 ml/min or 0.01 ml/min., was used in experiments. In the experiments, the collector 28 was grounded aluminum foil on a metal sheet. During the processing, the temperature $T_3$ is provided by circulating hot air in duct 26 to provide conductive heating without the interference with the whipping motion that would be provided by convective heating, and the heating chamber 10 used in the experiments was constructed of thermally and electrically insulating material based on $CaSiO_3$ and heating coils in chamber 10 were surrounded by a Faraday cage, to prevent leaking of current into chamber 10 and induction of voltage in the heating coils.

We turn now to the operation of the apparatus of FIG. 1 for elevated temperature solution electrospinning. Solvent and polymer or nanocomposite are homogenized in a high temperature oven (not shown) to form elevated temperature homogeneous solution. The plunger 13 is removed from the syringe 11, the elevated temperature solution is introduced into the syringe 11 and the plunger 13 is then inserted so that any leakage is prevented. The syringe 11 with elevated temperature polymer or nanocomposite solution therein is placed in the heating chamber 10. The temperature in the heating chamber 10 is controlled via 12 and 15 to maintain the elevated temperature of the polymer or nanocomposite solution. The mini-pump 18 is activated to feed the elevated temperature polymer or nanocomposite solution through needle/spinneret 20. The temperature $T_2$ is provided by electrically shielded heater 41 in response to controller 40 so as to maintain the polymer solution at elevated temperature and viscosity such that droplets are formed in needle/spinneret 20. The high voltage source 22 effects a voltage, e.g., 10 to 30 kV, at the tip(s) or orifice(s) of 20 positioned 2 to 12 inches from collector 28. Voltage is not induced by the high voltage applied at the tip(s)/orifice(s) in the heater coil of heater 10 because of shielding in 10. An electrostatic field strength, e.g., of 1 to 10 kV/cm, where cm refers to the distance between droplet forming orifice of passageway 20 and the collector 28 is provided to drive the flow of polymer or nanocomposite solution to produce an electrified fluid jet of polymer or nanocomposite solution and whipping action. Just as in the case of melt electrospinning, whipping action and elongation of produced fiber occurs because of local variations of surface charges and electric field. The temperature control provided by circulating hot air in jacket 26 of guiding chamber 25 provides a temperature $T_3$ that is not so low that quenching of the fiber is provided and not so high that the fluid jet is broken or relaxation is induced. In addition, a temperature 21 is provided to potentiate flashing off of solvent. In the experimental setup used in experiments involving the invention, the guiding chamber is not a closed system and the solvent evaporates and is vented through a hood. In a commercial setup, an outlet is provided in the collection chamber for exit of evaporated solvent and that outlet leads to a collection chamber outside the guiding chamber, so the recovered solvent can be recycled or disposed of. After flashing off of solvent, the fiber is elongated and collected as in the case of melt electrospinning operation described above.

We turn now to apparatus of the invention herein involving continuous operation for melt electrospinning.

Figure 2:
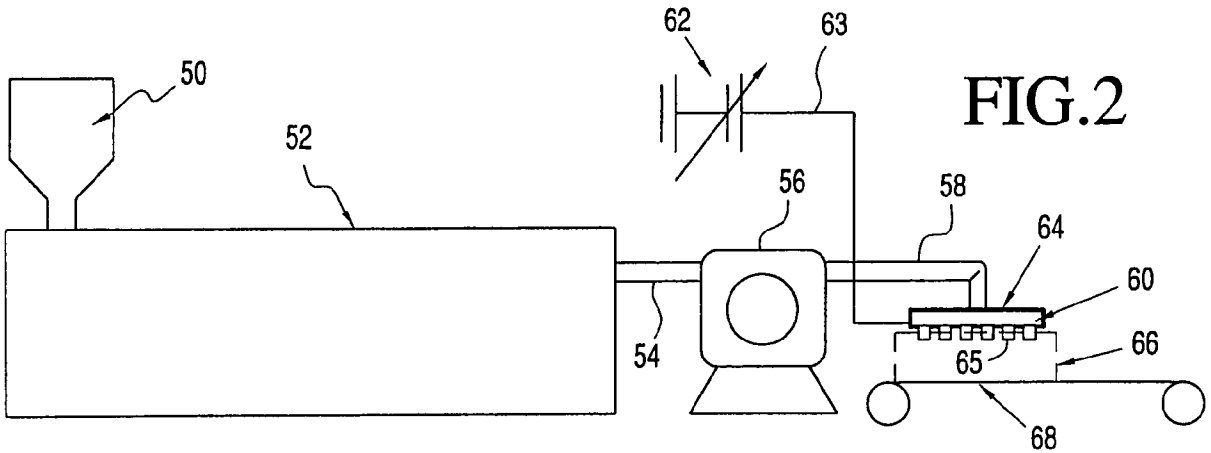
FIG. 2 is a schematic depiction of melt electrospinning apparatus of the invention herein for continuous operation.

With continuing reference to FIG. 2 of the drawings, a hopper 50 is provided for holding and feeding chunks of polymer or nanocomposite into a melt extruder 52 which conveys and melts polymer or nanocomposite fed by hopper 50 and provides molten polymer or nanocomposite at its outlet. Heat is supplied in the extruder to melt the polymer or nanocomposite. Heat is provided in the extruder for melting, e.g., by indirect heat exchange, e.g. with steam or superheated steam circulating in a jacket for the extruder. The melted polymer or nanocomposite from the extruder is pumped by force caused by the worm of the extruder via a pipe 54 to the inlet of a melt pump 56 which is available as an item of commerce. The melt pump 56 contains a resistance heater (not shown) to maintain the polymer or nanocomposite in molten form and force molten polymer or nanocomposite through a pipe 58 to a die header 60 containing multiple nozzles 65. A high voltage source 62 supplies high voltage, e.g., 10 kV to 30 kV where the distance from the nozzle outlets to a collector is 2 to 10 inches, via a conductive element 63 to the nozzles 65 to provide an electrostatic field strength, e.g., 1 to 10 kV/cm, where cm refers to the distance from nozzle outlet to fiber collector. The electrical insulation 64 on die header 60 shield the die frame and nozzles from the resistance heater of the melt pump 56 so voltage is not induced in the coil of the melt pump 56. The nozzles 65 contain orifices which communicate with a guiding chamber 66 which is heated by infrared (IR) apparatus (a IR chamber is being built composed of a ceramic infrared radiant heating panel on one side and a glass or metal reflector on the opposite side and the amount of IR radiation from the ceramic panel is controlled, e.g., by feedback of a thermocouple on the reflector, to control the temperature in the chamber; alternatives for ceramic as the IR emissive heating medium are quartz and metal. At the outlet side of the guiding chamber 66 is a continuous collector 68 which can be a moving belt which can be in association with a heater moving at a speed consistent with providing annealing.

To change the system of FIG. 2 to one for continuous elevated temperature solution electrospinning, mixer at elevated temperature is used in place of the melt extruder and solvent trapping apparatus is provided outside of and in communication with the guiding chamber to collect solvent.

Turning now to operation of the continuous system for melt electrospinning, chunks of polymer or nanocomposite are fed from hopper 50 to melt extruder 52 which provides at its outlet a melt of polymer or nanocomposite. The melt is delivered to melt pump 56 via pipe 54 and is transmitted through pipe 54 by pumping action of extruder 54 and suction of melt pump 56. The melt pump 56 maintains the melt in melted condition and at suitable viscosity for droplet forming. The melt pump 56 delivers polymer or nanocomposite melt via pipe 58 to die header 60 and nozzles 65. The high voltage source 62 supplies high voltage, e.g., 10 kV to 30 kV where the distance from nozzle orifice to collector is 2 to 10 inches, via conductive element 63 to the tips of nozzles 65. The electrostatic field produced thereby is shielded from the resistance heater of melt pump 56 by electrical insulation 64. Droplets of molten polymer or nanocomposite are formed at the nozzle tips and the field strength applied is sufficient to supply a charge to formed droplets, to provoke electrical jets of molten polymer or nanocomposite and whipping action to cause fiber formation and elongation. The IR heating in chamber 66 imparts a temperature above the quenching temperature of the polymer or nanocomposite but below a temperature causing induction of fluid jet disintegration or molecular relaxation in the fiber. The collector 68 is run at a speed such as to allow for collection of the fibers as a non-woven fabric and, if desired, annealing thereof.

Turning now to operation of the continuous system of FIG. 2 as modified for solution electrospinning, polymer or nanoclay solution is formed in the mixer at elevated temperature which is used in the place of the melt extruder. Otherwise, the operation is the same as the continuous operation of melt electrospinning as described above, except that solvent evaporating in the guiding chamber 66 is collected and recycled or disposed of.

Fibers of relatively uniform size are obtainable herein. The fiber diameter can be controlled by variation of needle/spinneret diameter, electric field strength (voltage/distance), infusion rate, distance from nozzle to collecting surface, nozzle temperature and guiding chamber temperature. Experiments described below obtained fibers of diameter of micron size down to 150 nm. More recently, fibers of a diameter of about 100 nm were obtained, that is nanofibers (fibers of diameter of 100 nm or less). For crystallizing polymers peaks associated with cold crystallization and p crystal structure become more distinct as $T_3$ decreases, and thus the crystallinity can be controlled by changing spinning temperature $T_3$. Experiments with PLA and PLA nanocomposites indicate that electrospinning induces βPLA crystal structure with fibrillar morphology.

The non-woven fabric formed in general has a specific surface area ranging from 10 $m^2$/g to 1,000 $m^2$/g and is useful, for example, for filtration, protective clothing, biomedical applications, reinforced composites, catalysts, and membranes. In experiments herein, 2"×2" and 5"×5" non-woven mats of 100-500 nm fibers were produced for evaluation.

The invention is illustrated in the following working examples. In these examples, the apparatus of FIG. 1 are used except that nozzle temperature $T_2$ was varied using circulating air. The experiments involved melt electrospinning and the polymer employed was polylactic acid of number average molecular weight of 186,000 and polydispersity of 1.76. The guiding chamber used was 10 inches in diameter. Annealing temperature was 60° C. and annealing was carried out for 120 minutes. Flow rate, distance from orifice to collecting plate, applied voltage, $T_2$, $T_3$ and nozzle diameter were varied. The temperature to melt the polymer in the heating chamber 10 was 200° C.

Working Example I

Effect of Flow Rate, Distance and Applied Voltage on Fiber Diameter

The nozzle diameter was 0.84 mm. The temperatures used were $T_2$=220° C., $T_3$=100° C. and $T_4$=60° C. Flow rates, distance between nozzle orifice and collector, voltage applied to the nozzle, are varied and results in terms of fiber diameter in μm are given in Table 1 below.

TABLE 1

| | | Voltage | | |
|---|---|---|---|---|
| Flow Rate | Distance | 10 kV | 15 kV | 20 kV |
| 0.01/ml/min | 3" | 3.23 ± 0.67 | 5.34 ± 0.67 | 14.29 ± 2.83 |
| | 6" | 7.65 ± 1.45 | 5.53 ± 0.91 | 8.21 ± 1.77 |
| 0.005 ml/min | 3" | 5.74 ± 1.45 | 4.85 ± 1.00 | 8.83 ± 1.66 |
| | 6" | 6.67 ± 1.10 | 4.70 ± 0.94 | 4.46 ± 2.19 |

Except for one case with 10 kV and 3 inches, decreasing flow rate decreases the fiber diameter, possibly due to the increase in residence time (and thus, lower exposure to whipping motion).

At higher voltage setting (20 kV), the straight stable jet tends to extend longer and thus the whipping region is shortened, which leads to thicker fibers. Increasing the distance (from nozzle tip to collector) and thus increasing the whipping region, gives rise to thinner fibers. At lower voltage (10 kV), the electric field is weak and thus increasing the distance decreases the whipping motion, leading to thicker fibers. At intermediate voltage (15 kV), these opposite influences on fiber diameter seem to even out so increase in distance from nozzle tip to collector results in almost no change in fiber diameter.

Working Example II

Effect of Nozzle Temperature ($T_2$) on Fiber Diameter

The nozzle diameter was 0.84 mm. The temperatures used were $T_3$=100° C. and $T_4$=60'; $T_2$ was varied. Flow rate was 0.01 ml/min. Voltage was 15 kV. Distance between the nozzle and collector was 3 inches. The results are given in Table 2 below:

TABLE 2

| $T_2$ (° C.) | Fiber Diameter (μm) | Standard dev. (μm) |
|---|---|---|
| 215 | 5.58 | 0.54 |
| 225 | 6.17 | 2.19 |
| 190 | 6.85 | 0.46 |
| 160 | 9.49 | 1.13 |
| 175 | 5.76 | 1.12 |
| 205 | 5.36 | 1.70 |

The results show that if $T_2$ is too high or too low, the fiber diameter tends to get thicker. Too low temperature freezes up the filament and thus less whipping motion can be induced. Too high temperature decreases the viscosity of the jet, and eventually continuous production of fiber would not be possible. High temperature (225° C.) also leads to poor size distribution. From the data it appears that $T_2$ of above 215 to 220° C. leads to small fiber diameter with uniform size distribution.

Working Example Iii

Effect of ($T_3$) on Fiber Diameter

The nozzle diameter was 0.84 mm. The temperatures used were $T_2$=220° C. and $T_4$=60°; $T_3$ was varied. Flow rate was 0.01 ml/min. Voltage was 15 kV, and distance between the nozzle and collector was 3 inches. The results are given in Table 3 below:

TABLE 3

| $T_3$ (° C.) | Fiber Diameter (μm) | Standard dev. (μm) |
|---|---|---|
| 25 | 15.0 | 2.54 |
| 100 | 5.34 | 0.67 |

The results show that increasing $T_3$ decreases fiber diameter, and with $T_3$=100° C., uniform size distribution is obtained.

Working Example IV

Effect of Nozzle Diameter on Fiber Diameter

The temperatures used were $T_2$=220° C., $T_3$=100° C., and $T_4$=60'. Flow rate was 0.01 ml/min. Voltage was 15 kV. Distance between the nozzle and collector was 3 inches. Nozzle diameter was varied. Results are set forth in Table 4 below.

TABLE 4

| Nozzle Diameter (mm) | Fiber Diameter (μm) | $T_3$ (° C.) |
|---|---|---|
| 0.84 | 15.0 | 25 |
| 0.30 | 6.35 | 25 |
| 0.15 | 2.95 | 25 |
| 0.12 | 1.51 | 25 |
| 0.84 | 5.34 | 100 |
| 0.30 | 2.26 | 100 |
| 0.15 | 1.05 | 100 |
| 0.12 | 0.54 | |

The results indicate that the nozzle diameter significantly influences the average diameter of electrospun fibers. At a given spinning temperature, the diameter gradually decreases with decreasing the nozzle diameter. However, the pressure drop required to feed the flow drastically increases (the pressure drop is roughly proportional to 1/diameter$^2$) as the nozzle diameter decreases.

Working Example V

Effect of Configuration of the Spinning Setup

The temperatures used were $T_2$=220° C., $T_3$=100° C., and $T_4$=60'. Flow rate was 0.01 ml/min. Voltage was 15 kV. Distance between the nozzle and collector was 3 inches. The electrospinning setup was varied. Results are set forth in Table 5 below.

TABLE 5

| Spinning Configuration | Fiber Diameter (μm) | Standard dev. (μm) |
|---|---|---|
| Vertical (downward) | 10.0 | 1.76 |
| Horizontal | 5.34 | 0.67 |
| Vertical (upward) | 0.85 | 0.57 |

The results indicate that the degree and extent of whipping during electrospinning decreases with increased effect of gravity. Hence, the fiber diameter becomes smaller as the whipping motion is more affected by gravity. A smaller fiber dimension increases the ratio of surface area to volume (or mass) of electrospun mats (fabrics). Thus, smaller fiber dimension provides larger ratio of surface area to volume or mass for those applications where this is important, e.g. catalytic reactions, cell growth, etc. Moreover, smaller fiber dimension provides enhanced effects for filtration applications. For example, smaller fibers constituting filter media will collect smaller dust particles without increasing pressure drop, because of slip flow at small fiber interface. Hence, filtration efficiency increases with smaller dimension fibers.

Variations

The foregoing description of the invention has been presented describing certain operable and preferred embodiments. It is not intended that the invention should be so limited since variations and modifications thereof will be obvious to those skilled in the art, all of which are within the spirit and scope of the invention.

What is claimed is:

1. A method for melt electrospinning production of non-woven fabric from meltable thermoplastic polymer or meltable thermoplastic polymer nanoclay nanocomposite, said method comprising the steps of:

(a) melting thermoplastic polymer or nanocomposite in a melting zone, wherein shielding with an electrostatic shielding element is provided;

(b) moving the melted thermoplastic polymer or nanocomposite through the melting zone by a force supplier upstream of or in the melting zone;

(c) providing an electric charge on the melted polymer to overcome the surface tension on the melted polymer to produce a jet of melted polymer or nanocomposite and provide unstable flow involving a plurality of electrically induced bending instabilities/whipping motions and elongation of and production of polymer or nanocomposite fibers; and (d) collecting of the elongated fibers to form a non-woven fabric.

2. The method of claim 1, additionally comprising the step of:

(e) providing a temperature for the polymer or nanocomposite being subjected to electrically induced bending instabilities/whipping motions and fiber elongation so as to provide against premature solidification and to provide against induction of relaxation of molecular orientation without affecting the electrically induced bending instabilities.

3. The method of claim 2, comprising the additional step of annealing the collected fibers to impart stability and molecular orientation.

4. A method for high temperature solution electrospinning of non-woven fabric from thermoplastic polymer or thermoplastic polymer nanoclay nanocomposite that is not dissolvable at room temperature in an acceptable solvent, said method comprising the steps of:

(a) homogenizing the polymer or nanocomposite in solvent in a first elevated temperature zone to form a solution of the polymer or nanocomposite in the solvent;

(b) maintaining the solution at a temperature sufficient for maintaining dissolution in a second elevated temperature zone, wherein shielding with an electrostatic shielding element is provided;

(c) moving the solution through the second elevated temperature zone by a force supplier upstream of or at the second elevated temperature zone;

(d) providing an electric charge on the solution to overcome the surface tension of the solution to produce a jet of polymer or nanocomposite solution and provide unstable flow involving a plurality of electrically induced bending instabilities/whipping motions and flashing off of solvent and elongation of and production of polymer or nanocomposite fibers; and (e) collecting the fibers to form a non-woven fabric.

5. The method of claim 4, additionally comprising the step of:

(g) providing a temperature for the polymer or nanocomposite and solution thereof being subjected to electrically induced bending instabilities/whipping motions and fiber elongation to provide against premature solidification and to provide against induction of relaxation of molecular orientation and potentiate flashing off of solvent, without affecting the electrically induced bending instabilities.

6. The method of claim 5, comprising the additional step of annealing the collected fibers to impart stability and molecular orientation.

7. The method of claim 2, additionally providing the step of providing a guiding chamber for the polymer or nanocomposite being subjected to electrically induced bending instabilities/whipping motions and fiber elongation.

8. The method of claim 7, wherein the temperature is provided by the guiding chamber.

9. The method of claim 5, additionally providing the step of providing a guiding chamber for the polymer or nanocomposite being subjected to electrically induced bending instabilities/whipping motions and fiber elongation.

10. The method of claim 9, wherein the temperature is provided by the guiding chamber.

* * * * *